US008664873B2

(12) United States Patent
Zudrell-Koch et al.

(10) Patent No.: US 8,664,873 B2
(45) Date of Patent: Mar. 4, 2014

(54) OPERATING CIRCUIT FOR LIGHT-EMITTING DIODES

(75) Inventors: Stefan Zudrell-Koch, Hohenems (AT); Michael Zimmermann, Heiligkreuz (CH)

(73) Assignee: Tridonic GmbH & Co KG, Dornbirn (AT)

( * ) Notice: Subject to any disclaimer, the term of this patent is extended or adjusted under 35 U.S.C. 154(b) by 187 days.

(21) Appl. No.: 13/318,083

(22) PCT Filed: Apr. 30, 2010

(86) PCT No.: PCT/AT2010/000139

§ 371 (c)(1), (2), (4) Date: Jan. 13, 2012

(87) PCT Pub. No.: WO2010/124313

PCT Pub. Date: Nov. 4, 2010

(65) Prior Publication Data

US 2012/0104958 A1 May 3, 2012

(30) Foreign Application Priority Data

Apr. 30, 2009 (AT) ..... GM280/2009 U

(51) Int. Cl.
*H05B 37/02* (2006.01)

(52) U.S. Cl.
USPC ..... 315/224; 315/225; 315/294

(58) Field of Classification Search
USPC ..... 315/224, 225, 276, 291, 294, 307, 206, 315/223
See application file for complete search history.

(56) References Cited

U.S. PATENT DOCUMENTS

| | | | | |
|---|---|---|---|---|
| 5,134,355 | A | 7/1992 | Hastings | |
| 7,276,861 | B1 * | 10/2007 | Shteynberg et al. | 315/291 |
| 7,598,682 | B2 * | 10/2009 | Grajcar | 315/291 |
| 8,228,001 | B2 * | 7/2012 | Fan | 315/291 |
| 2004/0178749 | A1 * | 9/2004 | Bucks et al. | 315/291 |
| 2007/0024213 | A1 * | 2/2007 | Shteynberg et al. | 315/291 |
| 2009/0273292 | A1 | 11/2009 | Zimmermann | |

FOREIGN PATENT DOCUMENTS

| | | | |
|---|---|---|---|
| AT | 508195 | A1 | 11/2010 |
| DE | 102006034371 | A1 | 10/2007 |
| EP | 0948241 | A2 | 10/1999 |
| WO | 2007016373 | A2 | 2/2007 |
| WO | 2007049198 | A1 | 5/2007 |
| WO | 2008068682 | A1 | 6/2008 |

* cited by examiner

*Primary Examiner* — Tung X Le
(74) *Attorney, Agent, or Firm* — Volpe and Koenig, P.C.

(57) ABSTRACT

A method is provided for operating at least one LED by a switched-mode regulator circuit to which a DC or a rectified AC voltage is supplied and which provides a supply voltage for at least one LED by a coil and a switch clocked by a control/regulation unit. When the switch is activated, power is temporarily stored in the coil and is discharged through a diode and through at least one LED when the switch is deactivated and the current flows through the LED through a first power storage element which is coupled to a second power storage element. The first power storage element just reaches its maximum capability of storing power due to the current flowing through the LED. A rising current is supplied to the second power storage element such that the time can be detected when the first power storage element recovers its capability of storing power.

17 Claims, 4 Drawing Sheets

Fig. 5
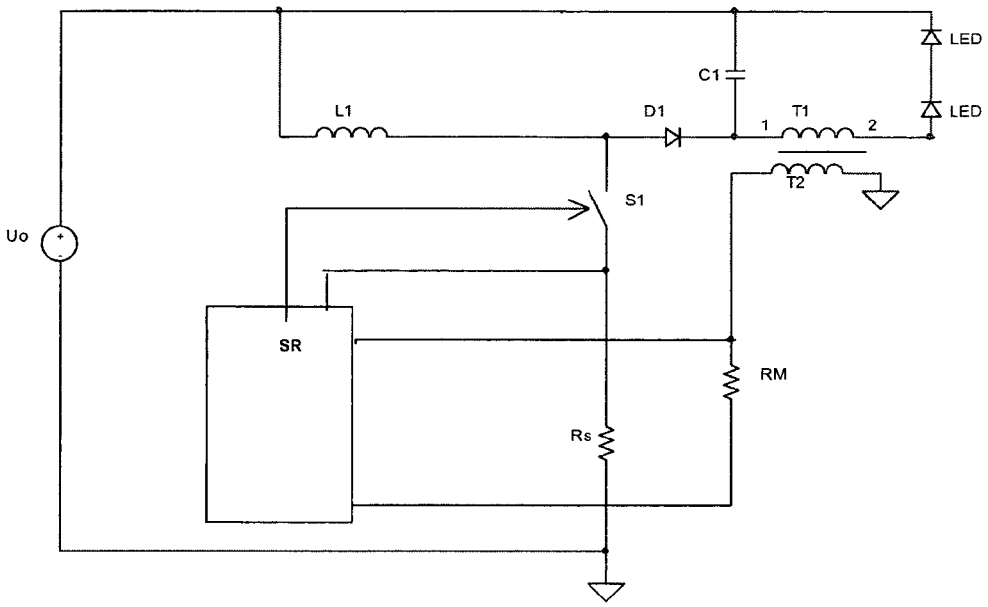
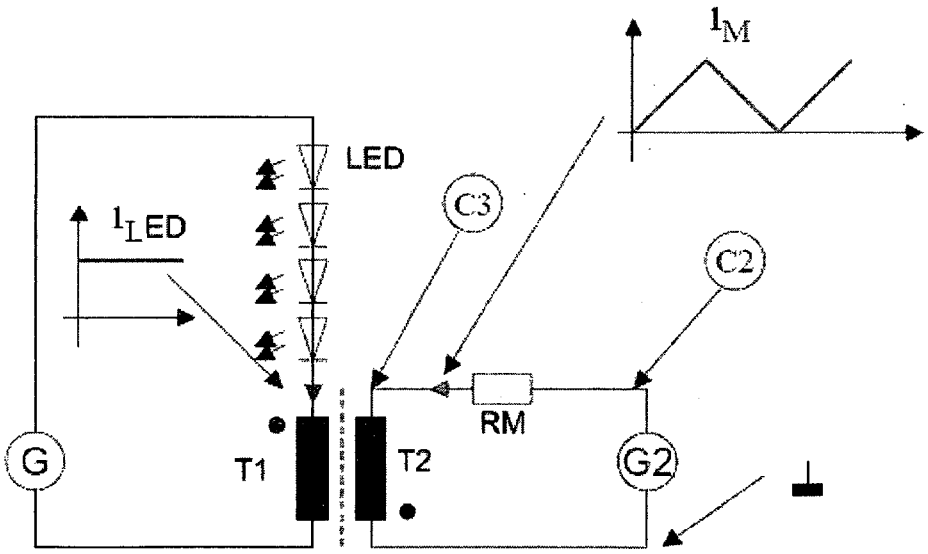
Fig. 6

OPERATING CIRCUIT FOR LIGHT-EMITTING DIODES

FIELD OF INVENTION

The invention relates to an operating circuit provided with light diodes, and to a method for operating light diodes.

BACKGROUND

Semiconductor light sources, such as for example light diodes, have been increasingly attracting attention in recent years in particular with regard to their application for illumination purposes. One of the reasons for this is that important technical innovations and major advances have been achieved with respect to brightness, but also with respect to light efficiency (the light output per Watt) of these light sources. Last but not least, it also became possible to develop light diodes which thanks to their relatively long lifespan represent an attractive alternative to conventional light sources such as incandescent (glowing) lamps or gas discharge lamps.

Semiconductor light sources are well known from prior art. Hereinafter, they will be abbreviated as LEDs (light emitting diodes). This term will include in the following text both light diodes that are made from inorganic materials, as well light diodes that are made from organic materials. It is known that the light irradiation from LEDs is correlated with the current flowing through the LEDs. In order to control brightness, LEDs are essentially operated in a mode in which the flow of the current is controlled by the LEDs. For example a switch controller (step-down or buck controller) is preferably used in practice in order to control an arrangement containing one or more LEDs. A similar switch controller is known for example for DE 10 2006 034 371 A1. In this case, a control unit controls a switch which is clocked at a high frequency (for example a power transistor). In the activated state of the switch, the current flows through the LED arrangement and a coil which is charged in this manner. The energy of the coil, which is stored with intermediate storage, is discharged through the LEDs (recovery phase).

The current displays a zigzag form of development through the LEDs: when the switch is in the activated state, the LED current displays a climbing edge, when the switch is turned off, a trailing edge is displayed. The mean value of the time interval of the LED current represents the effective current flowing through the LED arrangement as a measurement of the brightness of the LEDs. The mean effective current can thus be controlled with a suitable clocking of the power switch.

The function of the operating device is in this case to adjust the current flowing through the LED to a desired mean current flow, and to maintain the temporal fluctuations in the range of the variations of the current, which will depend on the high frequency that is used to turn the switch on and off (typically in the range above 10 kHz), at a level that is as low as possible. A wide range of variations of the current (waviness or ripples) exerts a particularly detrimental influence on the LEDs because the spectrum of the emitted light can be changed when the amplitude of the current is changed.

In order to maintain the spectrum of the emitted light as constant as possible, it is known that instead of varying the amplitude of the current to control the brightness of LEDs, a so called PWM (pulse width modulation) method can be used. The LEDs are in this case supplied using the lower frequency of the operating device (typically with a frequency in the range from 100-1,000 Hz) of the pulse width modulation packets at a constant current amplitude (on a time average). The current in one pulse packet is superimposed on the high frequency ripple mentioned above. The brightness of the LEDs can be then controlled with the frequency of the pulse packet, wherein the LEDs can be for example dimmed so that the time interval between the pulse packets is increased. A practical requirement on the operating device is that it should be possible to use the device universally and with as much flexibility as possible, for example independently of how many LEDs representing a load are in fact connected and operated. It should be also possible to change the load during the operation, for example when one LED fails.

Also according to conventional technology, the LEDs are operated in a so called "continuous conduction mode". This method will be explained in more detail with reference to FIG. 1*a* and FIG. 1*b* (conventional technology). In the example indicated in FIG. 1*a*, a step-down converter (buck converter) serves as a basic circuit for the operation of one LED (or several LEDs connected in series), which is equipped with a first switch S1. Direct current voltage or rectified alternating current voltage U0 is supplied to the operating circuit. The known circuits require an expensive measurement circuit in order to measure the current flowing through the LED during the switched off phase, which can be done for example by measuring the voltage through the LED when the current is turned off. However, a high differential voltage measurement with a high potential is required in this case.

When the first circuit S1 is turned on, energy is built up in the coil L1 (during the time period t_on), and it is then discharged in the turned off state of the first switch S1 (time period t_off) through at least one LED. The resulting current profile with respect to time is illustrated in FIG. 1*b* (conventional technology). Two pulse packets PWM are indicated in this case. The current profile within one pulse packet is shown at a magnified scale. In order to maintain a constant color, the amplitude of the ripple within the pulse packet should be as small as possible. This can be achieved with a suitable selection of the point in time t0 when the device is turned on, and of the point in time t1, which is the point when the device is turned off. These points in time can be selected for example so that the first switch S1 is activated when the current is below a certain minimum reference value, and so that the switch is turned off when the maximum reference value is exceeded.

SUMMARY

The task of the present invention is to provide an operating circuit which is an improvement of prior art, for at least one LED, and a method for enabling the operation of at least one LED, which makes it possible to maintain in a simple manner a constant current and thus also the LED performance.

This task is achieved in accordance with the invention based on the independent claims of the invention. The dependent claims represent a further development of the central concept of the invention in a particularly advantageous manner.

According to a first aspect of the invention, at least one LED direct current voltage or rectified alternating current voltage is supplied to the operating circuit. A supply voltage for at least one LED is provided by means of one coil and a first switch which is clocked by a control/regulation unit, wherein when the switch is turned on, power is temporarily stored in the coil and it is discharged through a diode and through at least one LED when the switch is turned off.

With the circuit according to the invention, the control/regulation unit selects the point in time to turn the switch on and off, so that the current flowing through at least one LED will have a ripple that is as small as possible.

The operating circuit according to the invention drives at least one LED, to which constant voltage or rectified alternating voltage is supplied, and which provides a supply voltage for at least one LED by means of a coil and a switch that is clocked by a control unit, wherein energy which is temporarily stored in the coil when the switch is turned on is discharged when the switch is turned off through at least one LED, while a transformer with a primary winding and a secondary winding is connected in series to the LED, and a measuring member is connected in series to the secondary winding so that a secondary circuit is formed, wherein a defined current is stored in the secondary winding and at least one measurement is carried out on the secondary side.

The invention thus essentially makes it possible to employ two connected energy storage units for the measurement of current with one LED, while this measurement can be carried out separately from the potential.

According to the invention, a method for operating at least one LED by means of a switch control circuit is provided, to which is supplied direct current voltage or rectified alternating voltage and which is provided through a coil and a switch clocked with a control/regulation unit with a supply voltage for at least one LED, so that energy, which is temporarily stored in the coil when the switch is turned on, is discharged when the switch is turned off through a diode and at least one LED, and so that the current flows through an LED via a first energy storage element, which is coupled to a second energy storage element, and the first energy storage element at least reaches the maximum energy storage capacity based on the current flowing through the LED, wherein the second energy storage element stores an increasing current so that the point in time can be ascertained at which the first energy storage element again requires energy storage capacity due to the current flowing through the second energy storage element.

In an embodiment of the invention, the operating circuit is equipped with a sensor unit which produces a sensor signal and monitors the current flowing through the LED.

According to the invention, the control unit uses a signal of the sensor unit or a combination with a signal of another optional sensor unit to determine the point in time when the switch is to be turned on and off.

According to the invention, the control/regulation unit switches the circuit off when the current flowing through the LED exceeds a maximum reference value, and turns the circuit back on again at the point in time when the current flowing through the LED is below a minimum reference value.

The sensor unit is provided in an embodiment of the invention with a sensor unit which is formed by two mutually coupled energy storage elements, for example with a transformer or a Hall sensor.

In a possible embodiment of the invention, the operating circuit is equipped with a capacitor, which is connected in parallel to at least one LED, and which maintains the current through the LED during the phase of the demagnetization of the coil so that the current is smoothed with the LED.

Other preferred embodiment and further modification of the invention are the subject of other dependent claims.

BRIEF DESCRIPTION OF THE DRAWINGS

The present invention will now be described in detail with reference to embodiments shown in the attached drawings.

FIG. 5 shows another embodiment of the invention (buck boost).

FIG. 6 shows another embodiment of the invention for measuring LED current.

DETAILED DESCRIPTION OF THE PREFERRED EMBODIMENTS

Figure 1A:
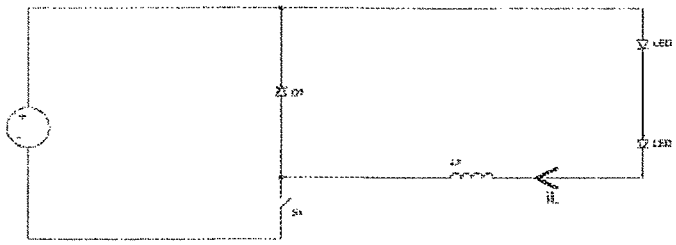
Fig. 1a (Prior art)
FIG. 1*a* shows a circuit arrangement according to prior art.
Figure 1B:
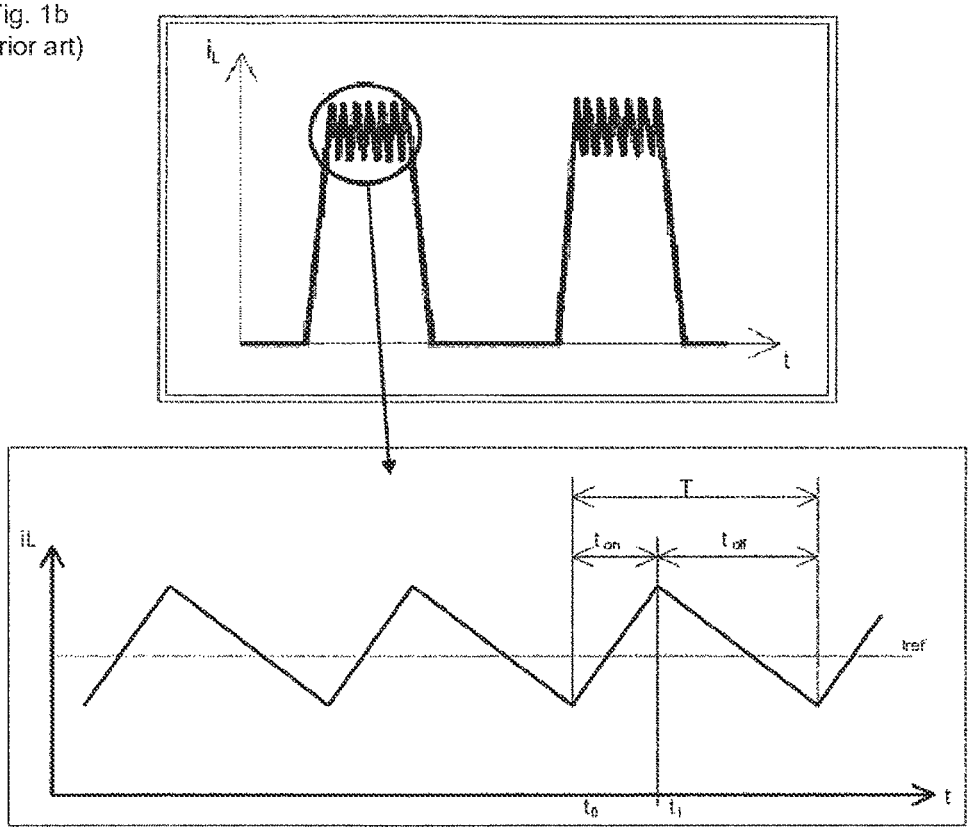
Fig. 1b (Prior art)
FIG. 1*b* shows a diagram indicating the temporal progress of the LED current in the circuit arrangement of FIG. 1*a* (prior art)

FIG. 1*a* and FIG. 1*b* show prior art.

Figure 2A:
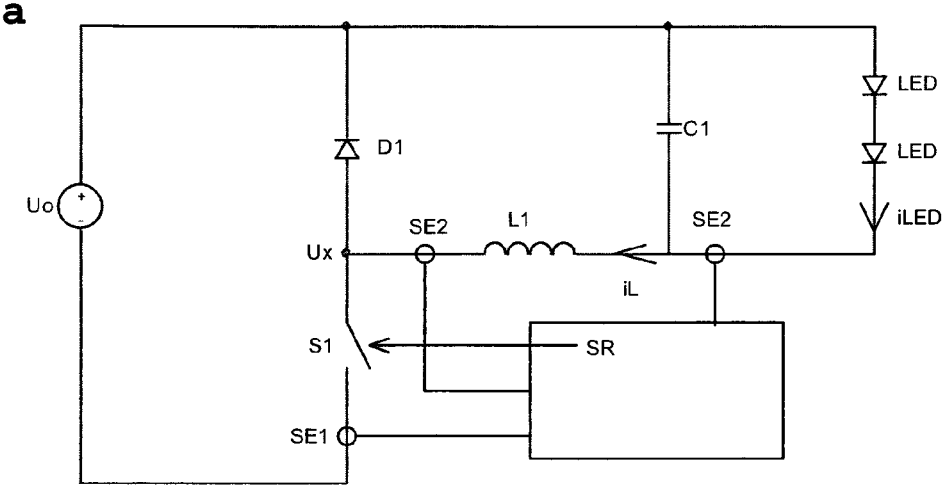
FIG. 2*a* shows a first embodiment of an operating circuit (buck) for LEDs according to the invention.

The circuit arrangement illustrated in FIG. 2*a* is used to operate at least one LED (or several LEDs connected in series). In the example indicated in the figure, for example two LEDs are connected in series, although this can be naturally also only one LED or several LEDs. The LED or the serially connected LEDs will be referred to commonly hereinafter as the LED (or also as the LED segment).

One advantage of the present invention is that the operating circuit is matched in a very flexible manner with the type of the LEDs which are connected in series. Direct current voltage U0 is supplied to the circuit, which can also naturally be rectified voltage. The LEDs are connected in series with a coil L1 and a switch S1. In addition, the circuit arrangement is equipped with a diode D1 (the diode D1 and the coil L1 are connected in parallel to the LEDs), and optionally also with a capacitor C1 which is connected in parallel to the LEDs. In the switched-on state of the circuit S1, the current flows through the LEDs and through the coil L1 which is thus magnetized. In the switched-off state of the switch S1, the energy which is stored in the magnetic field of the coil is discharged through the diode D1 and the LEDs. In parallel to this, the capacitor C1 is charged at the beginning when the switch S1 is turned on. During the switched-off phase of the switch S1 (recovery phase), the capacitor is discharged and it contributes to the flow of the current through the LED segment. With a suitable dimensioning of the optional capacitor C1, this can lead to a smoothing of the current through the LEDs. The coil L1 can be also a part of an energy transferring transformer.

For the switch S1 is preferably used a field effect transistor. The switch S1 is switched on at a high frequency, typically in a frequency range above 10 kHz.

According to the invention, the current flowing through the LED can be measured and thus maintained at a predetermined value or in a predetermined range of values.

Another advantage of the invention is that the switch S1 can be used sparingly during the operation because, as will be described later, it can be switched on when the output to be applied to it is almost at zero.

In the circuit of FIG. 2*a* is further also provided a control and/or regulation unit SR (hereinafter referred to as control/regulation unit SR), which is used to regulate the LED output or the iLED of the LED current which predetermines the clocking of the switch S1. The control/regulation unit SR uses the input variable for the determination of the exact point in time for turning on and off the switch S1 of another optional sensor unit SE1 and at least the signals of one sensor unit SE1. Since the sensor unit S2 is located in the path in which measuring on the LED is possible during the switched-off phase of the circuit S1, this sensor unit will be hereinafter referred to as sensor unit SE2. The other sensor unit SE1, which is only optional, enables only a measurement during the switched-on phase of the switch S1 and it is therefore referred to as the other sensor unit SE1.

The sensor unit SE2 is arranged in a current branch through which the current flows during the recovery phase, preferably in series to the LED, or as an alternative in series to the coil L1 (referred to as SE2'). Using the sensor unit SE2, the control unit/regulation unit SR can determine a suitable point in time for turning the switch S1 on, and optionally also the point in time for turning the switch S1 off. According to a preferred embodiment of the invention, the switch S1 is turned off when the current flowing through the LED is below a specific value, and the switch S1 is then again turned on when the current flowing through the LED exceeds a specific value.

However, the switch S1 can be also turned on according to the invention when the current flowing through the coil L1, immediately after the diode D1 is blocked in the recovery phase, corresponds for the first time to zero, or at least to a very small value. In this case, since a low current is applied at the switch S1 at a point when the switch is turned on, almost lossless switching is thus enabled when zero current passing through the coil is recognized.

According to the invention, the current through the LEDs exhibits only a small waviness and weak fluctuations. This can be attributed to the use of the method of the invention for measuring the LED current iLED and, provided that a capacitor C1 is available, also to the smoothing effect of the capacitor C1 which is connected in parallel to the LEDs.

The progress of individual currents and the optimal point in time for switching the switch S1 on will now be explained in more details.

At the point in time t_0, the switch S1 is closed and a current starts to flow through the LED and the coil L1. The current i_L exhibits an increase according to an exponential function, wherein an almost linear increase of the iLED and i_L current occurs in the area that is of interest here. The iLED differs from i_L in that one part of the current i_L contributes to charging of the capacitor C1. The consequence of the opening of the switch S1 at the point in time t_1, (for example when a desired maximum reference value is reached), is that the energy which is stored in the magnetic field of the coil L1 via the diode D1 and the LEDs or the capacitor C1 is discharged. The current i_L continues flowing in the same direction, but it is continuously decreased and can even reach a negative value.

According to the invention, the switch S1 is already switched on again when the current iLED flowing through the LED is below a desired minimum reference value, whereby according to one preferred embodiment, it is only relatively slightly below the desired maximum reference value, (which determines the switching off of the switch S1), so as to ensure that current iLED that is as constant as possible will be flowing through the LED.

A negative current, (i.e. a current flow in the opposite direction), can be achieved when the coil L1 is demagnetized. This exists as long as the charge carriers, which were enriched in advance in the carrying polarized diode D1, are removed from the emptied blocking layer of the diode D1.

The current iLED, on the other hand, is decreased only slightly and will be maintained because the capacitor C1 has a smoothing effect. At the point in time t_2, which is to say when the blocking layer is emptied, the diode is blocking. The current i_L is increased, (but it will then be negative), and it then continues toward zero. Parasitic capacities are in this phase transferred to the diode D1 and other parasitic capacities are transferred to the rest of the circuit.

A preferred point in time t_3 for again switching on the switch S1 can now also occur when the current i_L reaches the zero crossing point. At this point in time, the coil L1 is not magnetized or hardly magnetized at all. The switch S1 can be turned on at this point in time with a very small loss since hardly any current is flowing through the coil L1.

The sensor unit SE2 is now used to detect an advantageous point in time for turning on the switch S1. In a first embodiment, the current i_L flowing through the LED is detected with the transformer, which is also indicated below in FIGS. 3*a* and 3*b*. The current iLED flowing through the LED, or alternatively the current i_L flowing through the coil L1, can be also detected, for example with a Hall sensor. In the case of the sensor unit SE2, it is preferred when a transformer connected in series to the LED is used with a primary winding T1) and with a secondary winding T2. A measurement member RM is connected in series to the secondary winding T2 so that a secondary circuit is formed, whereby a defined current is fed into the secondary winding T2 and at least one measurement is performed on the secondary side. The monitoring of the temporal progress of the voltage on the secondary side T2 makes it possible to make a prediction about an advantageous point in time for turning the switch S1 on again.

However, the switch S1 can be also controlled in such a way with the control/regulation unit SR that the mean value of the current iLED it is controlled through the LED.

Since direct current can be also measured with the invention, hysteretic regulation does not need to be used, as a control loop can be also employed so that only one measured value of the LED current iLED is evaluated as a nominal value. The control/regulation unit SR can control the switch S1 in such a way that the LED current iLED is regulated at a predetermined value.

The optional additional sensor unit SE1 is arranged in series to the switch S1 and detects the current flowing through the switch S1. This is used to monitor the current flowing through the switch S1. If the current flowing through the switch S1 exceeds a determined maximum reference value, the switch S1 is switched off. However, in a preferred embodiment, the additional sensor unit SE1 can be for example a measurement resistor (shunt), which is also subsequently indicated as a measurement resistor RS in the examples shown in FIGS. 3 through 5.

In order to monitor the current flow, the decreased voltage can now be detected at the measurement resistor (shunt) RS and compared for example with a comparator to the reference value. If the voltage reduction at the measurement resistor (shunt) is above a predetermined value, the switch S1 is switched off. The monitoring by means of the additional sensor unit SE1 can be used at least additionally, or as an alternative to the sensor unit SE2, for detection of the conditions for turning off the switch S1. It can be in this case used in particular also for protection of the switch S1 against overcurrents in the event of a failure.

The control/regulation unit SR uses the information of the optional additional sensor unit SE1 and of the sensor unit SE2 to determine the point in time for turning the switch S1 on and off. The regulation of the (time-averaged) LED performance can be realized with the control unit/regulation unit SR for an adjustment of the brightness of the LED for example in the form of PWM packets.

The frequency of the PWM signals is typically in the range of 100-1,000 Hz. The switch S1 itself is during the PWM period turned on and off with a significantly higher frequency.

FIG. 3 (3*a* and 3*b*) shows a possible embodiment of the invention.

The figures show an operating circuit for at least one LED, which supplies direct current voltage or rectified alternating voltage and through a coil L1 and a switch S1, and which is clocked by a control/regulation unit SR providing operating voltage for at least one LED. When the switch S1 is switched on, energy which is temporarily stored in the coil L1 can be controlled so that it is discharged when the switch S1 is turned off through at least one LED. The operating circuit can thus be controlled so that the control/regulation unit SR determines the off time period toff, namely the period of time between turning the switch S1 off and then turning it next on again, which is determined depending on the measurement of the current iLED through the LED.

In this case, the control/regulation unit SR determines the current flowing through the LED by means of a transformer, which is connected in series with the LED and has a primary coil T1 and a secondary coil T2. Also, the control/regulation unit SR can supply an increasing current into the secondary winding T2 of the transformer. This occurs preferably through a current source loff that is connected to the control regulation unit SR. The control/regulation unit SR can monitor the voltage through the secondary coil T2 of the transformer via an analog/digital converter ADC. The current is also measured through the LED iLED via a sensor unit SE2 by means of a transformer.

The defined current, which is fed to the secondary coil T2 by a current source loff, can be a triangular current.

The defined current, which is supplied into the secondary winding T2 with a current source loff, can be also a triangular current having a fixed direct current voltage component DC-offset.

However, the defined current which is fed into the secondary winding T2 by the current source loff, can be also for example a DC reference current having a fixed amplitude onto which an alternating voltage component is superimposed with a defined amplitude and frequency.

It should be noted that depending on the type and quality of the current source loff, the defined current can display different stability, which may be in particular the case when saturation is reached in the secondary winding T2. Depending on the type of the current source which is used, various types of signal forms can be advantageous for the defined current, and the method used for the evaluation of the measurement on the secondary side can be adjusted according to the type of the current source loff that is used.

Therefore, it is possible to perform current measurements which can determine with a high precision the current being monitored, where the current can be also a direct current. At the same time, this current measurement can be conducted in such a way that potential separation is provided between the current path to be measured and the evaluation circuit (T2 and SR).

The current being measured, (which can be also a direct current as has already been mentioned), has preferably an amplitude which is above the saturation current of the transformer, while the current to be measured is preferably significantly above the saturation current of the transformer in order to ensure reliable measurement.

The transformer is thus operated in saturation when the current being measured flows with a corresponding amplitude through the transformer (i.e. through the primary winding).

When a defined current after that flows into the secondary winding T2 which is provided with an increasing amplitude, a magnetic flux is built based on this current through the secondary winding T2 and the result is that the voltage is decreased and a magnetic flux is created via the secondary winding T2. Since the primary winding T1 and the secondary winding T2 are magnetically coupled, the magnetic flux caused by the currents flowing through the primary winding T1 and the secondary winding T2 are cancelled out as soon as their values are at the same level.

With a winding ratio of the primary winding T1 to the secondary winding T2 of 1:1 (i.e. that the number of the primary windings corresponds to the number of the secondary windings), the magnetic fluxes in the transformer are cancelled out as soon as the current stored on the secondary side in the transformer corresponds to the current which is monitored on the primary side.

Once the current defined in the secondary winding T2 exceeds the current to be monitored, the secondary winding T2 goes to saturation, which can be recognized with a monitoring on the secondary side (for example with a measurement at the resistance RM). In the example illustrated in FIGS. 3*a* and 3*b*, a recognizable increase occurred through the resistance RM which was above the falling voltage of the resistance RM as soon as the secondary winding T2 goes to saturation.

The primary winding T1 thus forms a primary storage element, wherein a current flows through the LED and through the primary winding T1 as a first energy storage element, while the primary winding T1 is coupled as a first energy storage element with the secondary winding T2 as a second energy storage element. When the primary winding T1 has reached at least its maximum energy storage capacity as the first energy element based on the current flowing through the LED (that is saturated), and a defined current is stored preferably with an increasing amplitude in the secondary winding T2 as the second storage element, the point in time can be thus recognized at which the first energy storage element requires again an energy storage capacity based on the current flowing through the second energy element, which means that the primary winding T1 is no longer in the saturated state.

A control/regulation unit SR can monitor the voltage with the secondary winding T2 through an analog/digital converter ADC, for example at the measurement point C3 on the resistance RM. Instead of using an analog/digital converter ADC, the measurement can be also performed for example by means of a comparator. As soon as the monitored voltage exceeds the reference voltage supplied to the comparator, it can be for example determined that the transformer is no longer in saturation on the primary side based on the LED current.

Figure 3A:
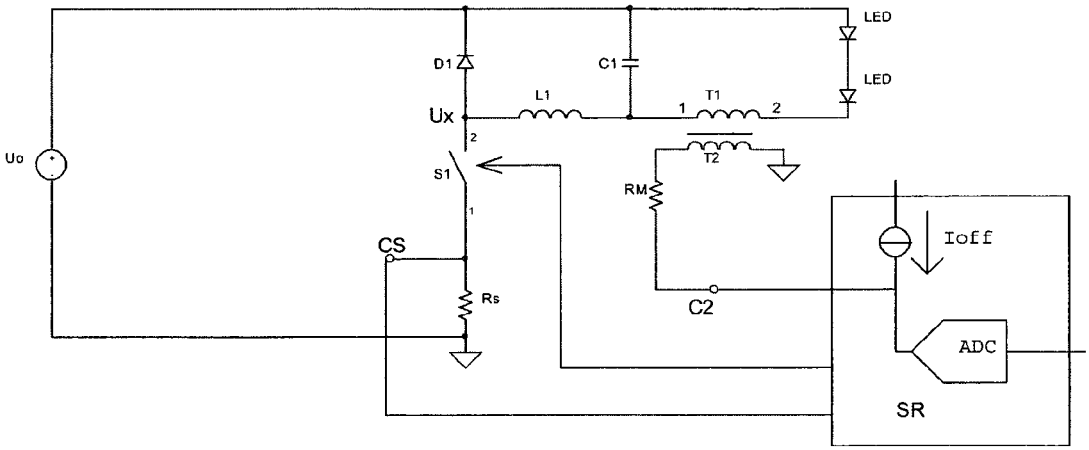
FIG. 3*a* and FIG. 3*b* show a particular embodiment of the invention.
Figure 3B:
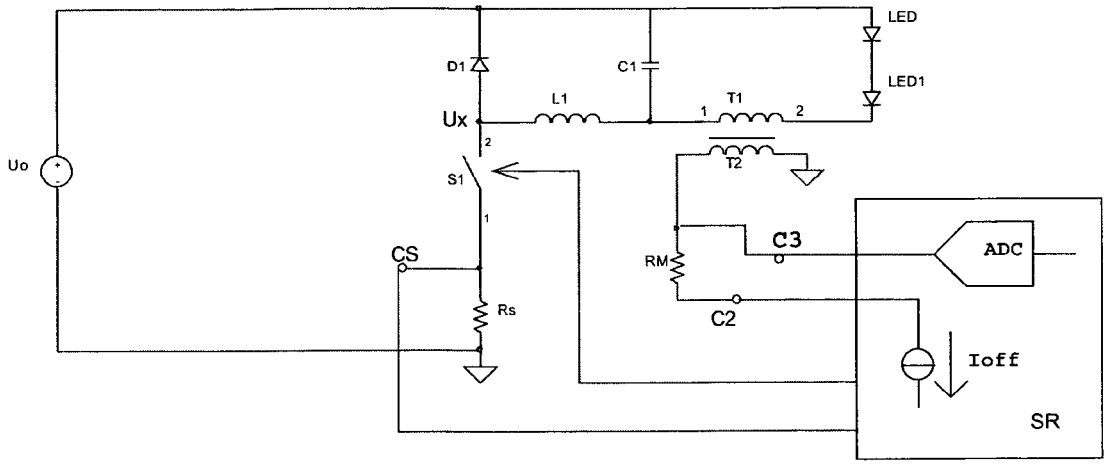

The difference between both embodiments shown in FIG. 3*a* and FIG. 3*b* is that in the example according to FIG. 3*a*, the control/regulation unit SR has only one connection C2 for storing the defined current in the secondary winding T2 and monitoring of the secondary winding T2 is required.

According to the example shown in FIG. 3*a*, the control regulation units SR is designed in such a way so that current can be also stored through the same connection (by means of the integrated current source loff), while the voltage can be monitored at the same time at the connection C2 (by means of an analog/digital converter ADC) in order to carry out the measurement on the secondary winding T2. According to the example shown in FIG. 3*b*, the control/regulation unit SR is designed in such a way that it can store through a first connection C2 a current in the secondary winding T2 (by means of the integrated current source loff), and so that it can monitor the voltage through the resistance RM through the connection C3 (by means of an analog/digital converter ADC) in order to carry out the measurement on the secondary winding T2.

Several measured values can be detected during the measurement on the secondary winding T2 within a predetermined time interval and they can be evaluated together. So for instance during the storage of a triangular current in the secondary winding T2, the falling edge of the voltage can be also detected through the resistance RM at the point in time when it is determined that the transformer is no longer in saturation based on the LED current on the primary side, or that it is again in saturation. In addition, the maximum peak value of the voltage can be also detected through the resistance RM, which is reached when the current stored in the secondary winding T2 reaches its maximum value.

It should be noted that for example during the storage of a triangular current as a defined current in the secondary winding T2, the opposite cycle naturally occurs with the falling edge when compared to the rising edge. As long as a defined current is stored in the secondary winding with such a high amplitude that it exceeds the current on the primary side of the transformer, the secondary winding T2 will be in the saturated state. When the current then falls through the secondary winding so much that the magnetic flux induced on the secondary side no longer exceeds the primary side, the secondary winding T2 will leave the saturated state and instead, the primary winding T1 will again reach the saturated state. The point in time is thus triggered with a falling edge in this manner at which the primary winding T1 reaches the state of saturation.

The monitoring on the connection C2 can be also performed with a capacitor. In particular with the variant when a DC reference current Ioff is supplied from the current source together with a superimposed alternating current component having a defined amplitude and frequency, the evaluation can be also performed with a comparator which is constantly toggled (in particular when the reference is toggled) to make it possible to use it to monitor both edges of the defined current.

Different references can thus be provided for the rising and falling edges.

It is also possible to monitor and evaluate during this monitoring also the signal over a period of time. The time period which can be in particular monitored in this case is the time period until it is determined that the transformer is no longer in saturation on the primary side due to the LED current. While taking into consideration the increase of the defined current, the level of the monitored current can be locked, based on this time period.

The reference for the comparator can be also provided for example with a digital/analog converter.

The control/regulation unit SR can perform the measurement of the current in such a way that the defined current is stored in the secondary winding T2 through the current source Ioff only during the phase when the switch S1 is switched off.

The control/regulation unit SR can perform the measurement of the current iLED through the LED (by means of the voltage in the secondary winding T2) during the switched-off phase.

It is also possible to perform the measurement of the current as mentioned above through the LED by means of a sensor unit SE2 and a transformer.

However, the sensor unit SE2 can also be designed as a Hall sensor, in particular with mutually coupled elements of a Hall sensor.

Figure 4:
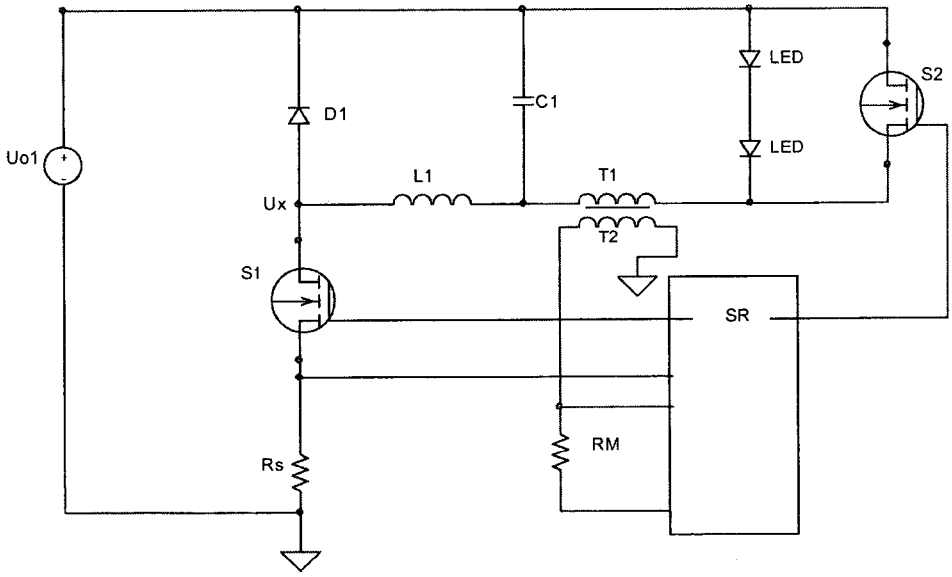
FIG. 4 shows another embodiment of the invention.

FIG. 4 and FIG. 5 show particular embodiments of the invention.

FIG. 4 shows a modification of the circuit of FIG. 3, which differs in that a second switch S2 is additionally connected in parallel to the LEDs and the condenser C1. The switch S2 can be controlled selectively/independently and it can be for example a transistor. When the switch C2 is connected, the discharging cycle of the capacitor C1 is accelerated. Thanks to the accelerated discharging of the capacitor C1, the current flows through the LED as quickly as possible towards zero.

This is desirable for example at the end of an PWM packet where the current flowing through the LED should be decreased as quickly as possible, which is to say that the falling edge of the current cycle should be as steep as possible (for reasons relating to constant colors).

The switch S2 can be preferably activated and controlled at a low dimming level when the PWM packets are very short and it is important for the current flowing through the LED to reach quickly zero at the end of the PWM packet. An even lower dimming level can be achieved for example with a suitable control of the switch S2.

Another function of this switch S2 is that it bridges over the LEDs during the state when it is turned on. This is required for example when the LEDs need to be turned off, namely when no light should be emitted, but when the supply voltage U0 is still applied. Without the bridging over function provided with the switch S2, a (small) current would be flowing through the LEDs and the resistances R1 and R2 and the LEDs would be (slightly) emitting light.

It should be noted that the connection of a second switch S2 in parallel to the LEDs and the capacitor C1 is not limited only to the special embodiment of the circuit arrangement shown in FIG. 4, since it can be applied to all embodiments of the invention.

It should be also noted that the method for measuring current flowing through the LED, preferably for the detection of an advantageous point in time for turning the switch S1 on and/or off, can be naturally applied also to other circuit topologies, for example to a so called buck boost converter, to a semiconductor converter, or to a so called forward converter (through-flow converter).

FIG. 5 shows a modification of the circuit of FIG. 2*a*, which differs in that the arrangement of the choke L1 and of the diode D1, as well as the orientation of the LED segment are modified. The circuit shown in the figure represents a so called buck boost converter which is also referred to as an inverter circuit. A transformer having a primary winding T1 and a secondary winding T2 are again connected in series to the LED. A measuring member RM is arranged in series to the secondary winding T2 so that a secondary circuit is formed, wherein a defined current is stored in the secondary winding T2 and at least one measurement is performed on the secondary side in order to monitor the LED current iLED.

The invention essentially makes it possible to perform measurements for an LED with potential separation as was already mentioned, independently of the topology which is employed to control the LED.

FIG. 6 shows a section of a control circuit for at least one LED which is analogous to the circuits of the examples described so far.

A similar operating circuit drives typically at least one LED to which is supplied direct current voltage or rectified alternating current voltage, and which provides a supply voltage by means of a coil L1 and a switch S1 that is clocked by a control/regulation unit SR for at least one LED, wherein energy is temporarily stored in the coil L1 when the switch is turned on, while the energy is discharged at least through one LED when the switch is turned off, and wherein a transformer having a primary winding T1 and a secondary winding T2 is connected in series to the LED, and a measuring member RM is connected in series to the secondary winding T2, so that a secondary circuit is formed, while a defined current is stored in the secondary winding T2 and at least one measurement is performed on the secondary side. It is preferred when the defined current IM is supplied with a current source loff, which is connected with the secondary winding T2, into the secondary winding T2. The measuring member can be a resistance RM (for example a current measurement shunt).

The current iLED can be determined by measuring on the secondary side with the LED.

The defined current IM, which is fed into the secondary winding T2 used as a coupled winding, can be triangular current.

This makes it possible to recognize the point in time at which the supplied triangular current exceeds the current iLED through the LED.

This point in time can be recognized by monitoring the voltage or with measuring on the secondary coupling T2 used as a coupled winding.

The point in time can thus be recognized when the supplied triangular current reaches a value when the transformer is no longer in saturation on the primary side due to the LED current iLED. This point in time can be recognized with the monitoring of the voltage, or by measuring at the secondary winding T2 which is used as a coupled winding.

Based on this recognized point in time, the level of the current iLED can be locked with the LED. The winding ratio of the transformer can be also taken into consideration in this case when determining the current. It is preferred when the winding ratio of the transformer is one to one (1:1).

The transformer can form the sensor unit SE2.

However, the sensor unit SE2 can be also a Hall sensor, in particular the sensor unit SE2 can be formed with Hall sensor elements which are mutually coupled.

A capacitor C1 can be connected in parallel to at least one LED and it can maintain the current iLED with the LED during the demagnetization phase of the coil L1 so that the current iLED is smoothed with the LEDs.

A switch S2 can be arranged in parallel to the capacitor C1 and the LEDs and it can be controlled independently.

The switch S2 can be closed in order to accelerate the discharging cycle of the capacitor C1.

A control/regulation unit SR can monitor the voltage through the secondary winding T2 using an analog/digital converter ADC.

The method thus makes it possible to operate at least one LED with a switching regulator circuit, to which is supplied direct current voltage or rectified voltage, and which provides by means of a coil L1 and a switch S1 that is clocked with a control/regulation unit SR operating voltage for at least one LED, wherein when the switch S1 is switched on, energy is temporarily stored in the coil L1, and it is then discharged when the switch S1 is switched of through a diode D1 and through at least one LED, wherein the current iLED flows through the LED through a first energy storage element, which is coupled with a second energy storage element, and the first energy storage element at least reaches based on the current iLED through the LED its maximum energy storage capability, wherein the second energy storage element is fed a defined Current IM, which preferably has an increasing amplitude, which makes it possible to recognize the point in time at which the first energy storage element requires again an energy storage capability based on the current flowing through the first energy storage element. The defined current IM, which is fed into the second energy storage element, can be also provided with triangular form.

The energy storage elements which are mutually coupled thus form the sensor unit SE2 and they can be formed by the magnetically coupled windings T1, T2 of a transformer.

However, the mutually coupled storage elements forming the sensor unit SE2, can be also formed with mutually coupled elements of a Hall sensor.

The switching regulator circuit thus forms an operating circuit for at least one LED.

The purpose of FIG. 6 is to make it clear in particular that potential-separated current measurement can be obtained for an LED according to the invention described above, regardless of which topology design is employed in order to control the LED.

What is claimed is:

1. An operating circuit for at least one LED, to which is supplied direct current voltage or rectified direct current voltage, and which provides by a coil (L1) and a switch (S1), which is clocked by a control/regulation unit (SR), an operating voltage for the at least one LED, wherein energy is temporarily stored in the coil (L1) when the switch (S1) is switched on, which is discharged through the at least one LED when the switch is turned off, wherein a transformer is connected in series to the LED with a primary winding (T1) and a secondary winding (T2), and a measurement member (RM) is connected in series to the secondary winding (T2), so that a circuit is formed, wherein the secondary winding (T2) supplies a defined current and at least one measurement is performed on a secondary side.

2. The operating circuit according to claim 1, wherein a current (iLED) is determined with the LED by a measurement on the secondary side.

3. The operating circuit according to claim 2, comprising a capacitor (C1), which is connected in parallel to the at least one LED, wherein during the phase of the demagnetization of the coil (L1), the current is maintained through the LED so that the current (iLED) is smoothed by the LEDs.

4. The operating circuit according to claim 3, further comprising a switch (S2), which is arranged in parallel to the capacitor (C1) and the LEDS and which is controlled independently.

5. The operating circuit according to claim 4, wherein the switch (S2) is closed in order to accelerate a discharging cycle of the capacitor.

6. The operating circuit according to claim 2, wherein the control/regulation unit (SR) controls the switch (S1) such that the LED current (iLED) is regulated at a predetermined value.

7. The operating circuit according to claim 1, wherein a defined current, which is fed into the secondary winding (T2), is a triangular current.

8. The operating circuit according to claim 7, wherein a point in time is recognized at which the supplied triangular current exceeds the current flowing through the LED.

9. The operating circuit according to claim 8, wherein the point in time is obtained with a voltage measurement or with a measurement at the secondary winding (T2).

10. The operating circuit according to claim 7, wherein the point in time is recognized at which the supplied triangular current reaches a value wherein the transformer is no longer in saturation on a primary side due to the LED current (iLED).

11. The operating circuit according to claim 10, wherein the point in time is obtained with a voltage measurement or with a measurement at the secondary winding (T2).

12. The operating circuit according to claim 7, wherein, the defined current is supplied to the secondary winding (T2) through a power source (loff).

13. The operating circuit according to claim 1, wherein the transformer forms a sensor unit (SE2).

14. The operating circuit according to claim 1, wherein a control/regulation unit (SR) monitors the voltage through the secondary winding (T2) with an analog/digital converter (ADC).

15. A method for detecting current flowing through at least one LED, comprising: coupling the current flows through a first energy storage element with a second energy storage element, and the first storage element reaches its maximum energy storage capacity due to the current (iLED) through the LED, and storing a defined current in the second energy storage element, with an increasing amplitude, so that the point in time can be is recognized at which the first energy storage element requires again an energy storage capacity due to the current flowing through the second energy storage element.

16. The method for detecting current flowing through at least one LED according to claim 15, wherein the energy storage elements are formed with coupled windings of a transformer (T1, T2).

17. The method for detecting current flowing through at least one LED according to claim 15, wherein the energy storage elements are formed with mutually coupled elements of a Hall sensor.

* * * * *

UNITED STATES PATENT AND TRADEMARK OFFICE

CERTIFICATE OF CORRECTION

PATENT NO. : 8,664,873 B2
APPLICATION NO. : 13/318083
DATED : March 4, 2014
INVENTOR(S) : Stefan Zudrell-Koch et al.

It is certified that error appears in the above-identified patent and that said Letters Patent is hereby corrected as shown below:

IN THE CLAIMS:

Column 13, in claim 15, line 12, change "the point in time can be is recognized at which the first energy" to -- the point in time is recognized at which the first energy --

Signed and Sealed this
Twentieth Day of May, 2014

Michelle K. Lee

Michelle K. Lee
*Deputy Director of the United States Patent and Trademark Office*